US010722938B2

(12) United States Patent
Muller et al.

(10) Patent No.: US 10,722,938 B2
(45) Date of Patent: Jul. 28, 2020

(54) PROCESS FOR CASTING NONFERROUS METALS INCLUDING LIGHT METALS AND CASTING MOLD

(71) Applicant: ASK CHEMICALS GMBH, Hilden (DE)

(72) Inventors: Jens Muller, Haan (DE); Diether Koch, Mettmann (DE); Marcus Frohn, Dormagen (DE); Jorg Korschgen, Cologne (DE)

(73) Assignee: ASK CHEMICALS GMBH, Hilden (DE)

( * ) Notice: Subject to any disclaimer, the term of this patent is extended or adjusted under 35 U.S.C. 154(b) by 196 days.

(21) Appl. No.: 15/692,911

(22) Filed: Aug. 31, 2017

(65) Prior Publication Data

US 2018/0056374 A1 Mar. 1, 2018

Related U.S. Application Data

(62) Division of application No. 12/445,973, filed as application No. PCT/EP2007/009110 on Oct. 19, 2007, now abandoned.

(30) Foreign Application Priority Data

Oct. 19, 2006 (DE) ..... 10 2006 049 379

(51) Int. Cl.
*B22C 1/18* (2006.01)
*B22D 11/00* (2006.01)

(52) U.S. Cl.
CPC ..... *B22C 1/185* (2013.01)

(58) Field of Classification Search
None
See application file for complete search history.

(56) References Cited

U.S. PATENT DOCUMENTS 2,457,971 A 1/1949 Voorhees
2,768,087 A 10/1956 Bird
(Continued)

FOREIGN PATENT DOCUMENTS

CS 218263 B1 2/1983
CS 218263 B1 4/2017
(Continued)

OTHER PUBLICATIONS

Commercial register excerpt of ASK Chemicals Feeding Systems GmbH (HRB 20448), online-handelsregister.
(Continued)

*Primary Examiner* — Devang R Patel
(74) *Attorney, Agent, or Firm* — Scott R. Cox

(57) ABSTRACT

The invention relates to a molding mixture for producing casting molds for metalworking, a process for producing casting molds, casting molds obtained by the process and also their use. To produce the casting molds, a refractory mold raw material and a binder based on water glass are used. A proportion of a particulate metal oxide selected from the group consisting of silicon dioxide, aluminum oxide, titanium oxide and zinc oxide is added to the binder, particular preference being given to using synthetic amorphous silicon dioxide. The molding mixture contains a phosphate as essential constituent. The use of phosphate can improve the mechanical strength of casting molds at high thermal load.

20 Claims, 3 Drawing Sheets

(56) References Cited

U.S. PATENT DOCUMENTS

Figure 1:
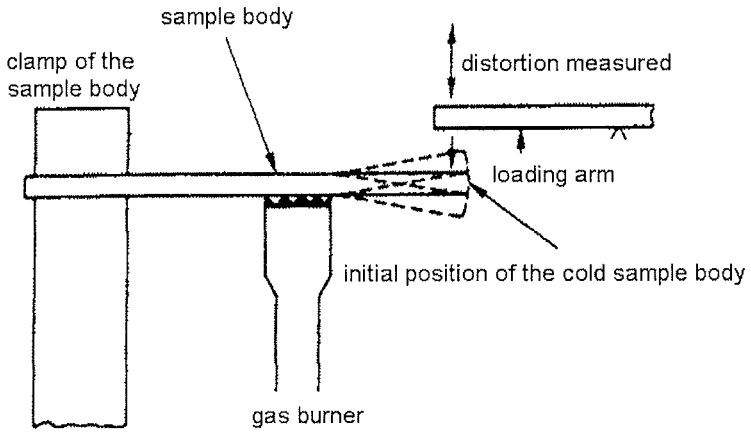
Figure 1:
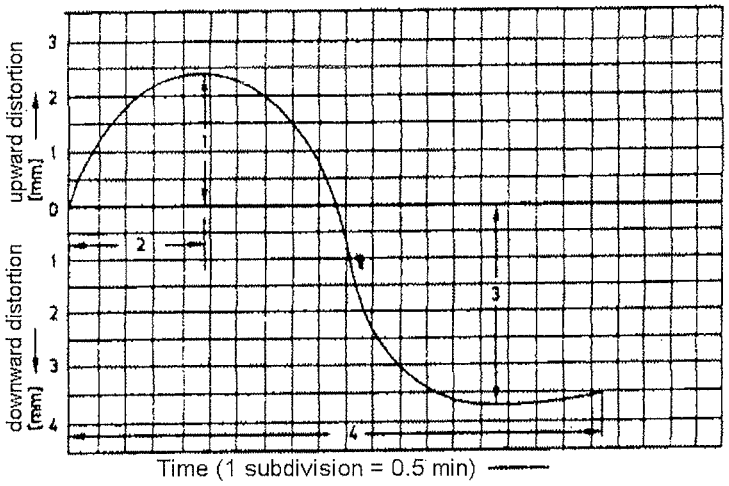

| | | | | |
|---|---|---|---|---|
| 2,881,081 | A | 4/1959 | Henricks | |
| 2,895,838 | A * | 7/1959 | Henda | B22C 1/185 106/38.3 |
| 2,926,098 | A | 2/1960 | Ilenda et al. | |
| 3,050,796 | A | 8/1962 | Moore | |
| 4,018,616 | A | 4/1977 | Sugahara et al. | |
| 4,113,499 | A * | 9/1978 | Ivanov | B22C 1/205 106/287.16 |
| 4,316,744 | A | 2/1982 | Bergna | |
| 5,089,186 | A | 2/1992 | Moore et al. | |
| 5,743,953 | A | 4/1998 | Twardowska et al. | |
| 6,299,677 | B1 | 10/2001 | Johnson et al. | |
| 6,416,572 | B1 | 7/2002 | Eldemallawy et al. | |
| 7,022,178 | B1 | 4/2006 | Steinhauser | |
| 7,770,629 | B2 | 8/2010 | Weicker et al. | |
| 2005/0178522 | A1* | 8/2005 | Kurokawa | B22C 1/18 164/522 |
| 2010/0224756 | A1 | 9/2010 | Muller et al. | |
| 2010/0294454 | A1 | 11/2010 | Muller et al. | |

FOREIGN PATENT DOCUMENTS

| | | | | |
|---|---|---|---|---|
| DE | 1937964 | A1 | 8/1970 | |
| DE | 2059538 | A1 | 6/1971 | |
| DE | 106963 | B1 | 7/1974 | |
| DE | 2616709 | A1 | 1/1978 | |
| DE | 2854547 | | 6/1979 | |
| DE | 140213 | A1 | 2/1980 | |
| DE | 158090 | A1 | 12/1982 | |
| DE | 213369 | B1 | 9/1984 | |
| DE | 19701858 | A1 | 7/1998 | |
| GB | 813772 | A | 5/1959 | |
| GB | 1283301 | A * | 7/1972 | B22C 1/18 |
| GB | 1283301 | A | 7/1972 | |
| GB | 1357541 | A | 6/1974 | |
| GB | 1377071 | A | 12/1974 | |
| JP | S52124414 | | 10/1977 | |
| JP | S52124414 | | 4/2017 | |
| PL | 135210 | A1 | 10/1985 | |
| PL | 135210 | A1 | 4/2017 | |
| RO | 95104 | | 4/1988 | |
| RO | 95104 | | 4/2017 | |
| RU | 1156804 | A | 4/2017 | |
| RU | 1318345 | A1 | 4/2017 | |
| RU | 1424938 | A1 | 4/2017 | |
| RU | 1650318 | A1 | 4/2017 | |
| SU | 1156804 | A | 5/1985 | |
| SU | 1318345 | A1 | 6/1987 | |
| SU | 1424938 | A1 | 9/1988 | |
| SU | 1650318 | A1 | 5/1991 | |

OTHER PUBLICATIONS

Blähglas, SHKwissen.
Ingvar L. Svensson, "Chemistry and Mechanical Properties of Carbon Dioxide Cured Sodium Silicate Binders", Indian Foundry Journal, Jun. 1986, pp. 13-23.
A.D. Sarkar, "Some Properties of a few sodium silicate/Co2 bonded non-siliceous materials", The British Foundryman, Aug. 1963, pp. 367-373.
Xia Zhou et al., "Adhesive Bonding and Self-Curing Characteristics of alpha Starch Based Composite Binder for Green Sand Mould/Core", J. Mater. Sci. Technol., 2004, pp. 617-621, vol. 20 No. 5.
"Colloidal Silica", Wikipedia, the free encyclopedia, Feb. 7, 2017.
"Kieselgur", Wikipedia, The free encyclopedia, Feb. 23, 2017.
"Kieselsauren", Wikipedia, The free encyclopedia, Sep. 29, 2016.
J Sutherland et al., "Laboratory tests of scour at a seawall", HR Wallingford Ltd. Working with water, pp. 1-19.
"Sorbit", Wikipedia, The free encyclopedia, Apr. 26, 2017.
"Ottawa Sand" Definition, Dictionary of Construction, 2017.
"How to improve Strength and Durability of Concrete", Elkem ASA Materials, pp. 1-15.
"Peptized" definition, The Free Dictionary, pp. 1-3.
Hartmut Polzin Fachverlag Schiele und Schon GmbH 1. Auflage, Anorganishche Binder zur Form-und Kernherstellung in der Gieberei, Jun. 2012, ISBN: 978-3-7949-0824-0.
Jan Schlomach, Dissertation Feststoffbildung bei technischen Fallprozessen, Mar. 20, 2006, ISBN: 3-86644-024-3.
Opposition to EP2097192, Filed by Huttenes-Albertus Chemische Werke GmbH, May 17, 2017.
Opposition to EP2097192, Filed by Thomas Steinhauser, May 17, 2017.

* cited by examiner

Picture 4. Principle of the BCIRA Hot Distortion Test

Picture 5. Key to the graph from the BCIRA Test

1. Maximum expansion
2. Time to start of distortion
3. Hot distortion
4. Time to fracture

PROCESS FOR CASTING NONFERROUS METALS INCLUDING LIGHT METALS AND CASTING MOLD

CROSS-REFERENCE TO RELATED APPLICATIONS

This application is a divisional application based on U.S. application Ser. No. 12/445,973, filed Apr. 17, 2009, which was filed as a 371 US National State of International Application No. PCT/EP2007/009110, filed Oct. 19, 2007, and claims priority to Germany patent application no. 10 2006 049 379.6, filed Oct. 19, 2006, the disclosures of which are herein incorporated by reference in their entirety.

DESCRIPTION

The invention relates to a molding mixture for producing casting molds for metalworking, which comprises at least one refractory mold raw material which is capable of powder flow, a binder based on water glass, and a proportion of a particulate metal oxide selected from the group consisting of silicon dioxide, aluminum oxide, titanium oxide and zinc oxide. The invention further relates to a process for producing casting molds for metalworking using the molding mixture and also a casting mold obtained by the process.

Casting molds for producing metal bodies are produced essentially in two forms. A first group is formed by cores or molds. The casting mold, which is essentially the negative of the casting to be produced, is assembled from these. A second group is formed by hollow bodies, known as feeders, which act as equilibration reservoirs. These take up liquid metal, with appropriate measures ensuring that the metal remains in the liquid phase for longer than the metal which is present in the casting mold forming the negative mold. When the metal solidifies in the negative mold, further liquid metal can flow from the equilibration reservoir in order to compensate for the volume contraction occurring on solidification of the metal.

Casting molds comprise a refractory material, for example silica sand, whose grains are bound together by means of a suitable binder after demolding of the casting mold in order to ensure sufficient mechanical strength of the casting mold. Thus, a refractory mold raw material which has been treated with a suitable binder is used for producing casting molds. The refractory mold raw material is preferably in a form which is capable of powder flow, so that it can be introduced into a suitable hollow mold and consolidated there. The binder produces firm cohesion between the particles of the mold raw material, so that the casting mold is given the required mechanical stability.

Casting molds have to meet various requirements. In the casting process itself, they firstly have to have sufficient stability and heat resistance to accommodate the liquid metal in the hollow space formed by one or more (parts of) casting molds. After commencement of solidification, the mechanical stability of the casting mold is ensured by a solidified metal layer which forms along the walls of the hollow space. The material of the casting mold then has to decompose under the action of the heat given off by the metal so that it loses its mechanical strength, i.e. cohesion between individual particles of the refractory material is lost. This is achieved, for example, by the binder decomposing under the action of heat. After cooling, the solidified casting is shaken, and in the ideal case the material of the casting molds disintegrates again to leave a fine sand which can be poured from the hollow spaces of the shaped metal body.

To produce casting molds, it is possible to use either organic or inorganic binders which can in each case be cured by cold or hot processes. The term cold processes is used to refer to processes which are carried out essentially at room temperature without heating of the casting mold. In this case, curing usually occurs by means of a chemical reaction which is, for example, triggered by a gas being passed as catalyst through the mold to be cured. In hot processes, the molding mixture is, after shaping, heated to a temperature which is sufficiently high for, for example, the solvent present in the binder to be driven off or to initiate a chemical reaction by means of which the binder is cured, for example by crosslinking.

At present, organic binders in the case of which the curing reaction is accelerated by a gaseous catalyst or the reaction is initiated by a gaseous hardener are frequently used for producing casting molds. These processes are referred to as "cold box" processes.

An example of the production of casting molds using organic binders is the Ashland cold box process. In this, a two-component system is used. The first component comprises the solution of a polyol, usually a phenolic resin. The second component is the solution of a polyisocyanate. Thus, according to U.S. Pat. No. 3,409,579 A, the two components of the polyurethane binder are caused to react by passing a gaseous tertiary amine through the mixture of mold raw material and binder after shaping. The curing reaction of polyurethane binders is a polyaddition, i.e. a reaction without elimination of by-products such as water. The further advantages of this cold box process include good productivity, dimensional accuracy of the casting molds and good technical properties such as strength of the casting molds, processing time of the mixture of mold raw material and binder, etc.

Hot-curing organic processes include the hot box process based on phenolic or furan resins, the warm box process based on furan resins and the Croning process based on phenolic novolak resins. Both in the hot box process and in the warm box process, liquid resins are processed together with a latent hardener which acts only at elevated temperature to give a molding mixture. In the Croning process, mold raw materials such as silica sands, chromium ore sands, zircon sands, etc., are surrounded at a temperature of from about 100 to 160° C. with a phenol novolak resin which is liquid at this temperature. Hexamethylenetetramine is added as reaction partner for future curing. In the abovementioned hot-curing technologies, shaping and curing take place in heatable tools which are heated to a temperature of up to 300° C.

Regardless of the curing mechanism, all organic systems can decompose thermally when the liquid metal is introduced into the casting mold and in the process give off harmful substances such as benzene, toluene, xylenes, phenol, formaldehyde and higher cracking products, some of which have not been identified. Although various measures have allowed these emissions to be minimized, they cannot be completely avoided when using organic binders. In the case of inorganic-organic hybrid systems which, as in the case of, for example, the binders used in the resol-$CO_2$ process, contain a proportion of organic compounds, such undesirable emissions also occur during casting of the metals.

To avoid the emission of decomposition products during the casting process, it is necessary to use binders which are based on inorganic materials or contain at most a very small proportion of organic compounds. Such binder systems have been known for a relatively long time. Binder systems which can be cured by introduction of gases have been developed. Such a system is described, for example, in GB 782 205 in which an alkali metal water glass which can be cured by introduction of $CO_2$ is used as binder. DE 199 25 167 describes an exothermic feeder composition which contains an alkali metal silicate as binder. Furthermore, binder systems which are self-curing at room temperature have been developed. Such a system based on phosphoric acid and metal oxides is described, for example, in U.S. Pat. No. 5,582,232. Finally, inorganic binder systems which are cured at relatively high temperatures, for example in a hot tool, are also known. Such hot-curing binder systems are, for example, known from U.S. Pat. No. 5,474,606 in which a binder system comprising alkali metal water glass and aluminum silicate is described.

Compared to organic binders, inorganic binders also have disadvantages, however. For example, the casting molds produced with water glass as binder have a relatively low strength. This leads to problems in particular when taking off the casting mold from the tool, since the casting mold can break. Good strengths at this point in time are particularly important for the production of complicated, thin-walled shaped bodies and handling them safely. The reasons for the low strengths is first and foremost that the casting molds still contain residual water from the binder. Longer residence times in the hot closed tool help to only a limited extent, since the water vapour cannot escape to a sufficient extent. To achieve very, complete drying of the casting molds, WO 98/06522 proposes leaving the molding mixture after demolding in a heated core box only until a dimensionally stable and load-bearing shell around the outside is formed. After opening of the core box, the mold is taken out and subsequently dried completely under the action of microwaves. However, the additional drying is complicated, increases the production time of the casting molds and contributes considerably, not least because of the energy costs, to making the production process more expensive.

A further weak point of the inorganic binders known hitherto is that the casting molds produced therewith have a low stability toward high atmospheric moisture. Storage of the shaped bodies for a relatively long period of time, as is customary in the case of organic binders, is therefore not reliably possible.

EP 1 122 002 describes a process which is suitable for producing casting molds for metal casting. To produce the binder, an alkali metal hydroxide, in particular sodium hydroxide, is mixed with a particulate metal oxide which can form a metalate in the presence of the alkali metal hydroxide. The particles are dried after a layer of the metalate has been formed on the outside of the particles. In the core of the particles, there remains a section in which the metal oxide has not been reacted. As metal oxide, preference is given to using a finely divided silicon dioxide or finely divided titanium oxide or zinc oxide.

WO 94/14555 describes a molding mixture which is suitable for producing casting molds and contains a refractory mold raw material together with a binder comprising a phosphate glass or borate glass, with the mixture additionally containing a finely divided refractory material. As refractory material, it is also possible to use, for example, silicon dioxide.

EP 1 095 719 A2 describes a binder system for mold sands for producing cores. The binder system based on water glass comprises an aqueous alkali metal silicate solution and a hygroscopic base, for example sodium hydroxide, which is added in a ratio of from 1:4 to 1:6. The water glass has an $SiO_2/M_2O$ ratio of from 2.5 to 3.5 and a solids content of from 20 to 40%. To obtain a molding mixture which is capable of powder flow and can also be introduced into complicated core molds and also to control the hygroscopic properties, the binder system contains a surface-active substance such as silicone oil having a boiling point of ≥250° C. The binder system is mixed with a suitable refractory solid such as silica sand and can then be shot into a core box by means of a core shooting machine. Curing of the molding mixture occurs by withdrawal of the water still present. The drying or curing of the casting mold can also be effected by means of microwaves.

In order to obtain higher initial strengths, better resistance of the casting mold to atmospheric moisture, and, in the course of casting, a better outcome with regard to the surface of the casting, WO 2006/024540 A2 proposes a molding mixture which in addition to a refractory mold raw material comprises a binder which is based on water glass. The molding mixture is admixed with a proportion of a particulate metal oxide. As particulate metal oxide it is preferred to use precipitated silica or fumed silica.

EP 0 796 681 A2 describes an inorganic binder for producing casting molds that comprises in dissolved form a silicate and also a phosphate. Phosphates used are preferably polyphosphates of the formula $((PO_3)_n)$, where n corresponds to the average chain length and is able to adopt values of from 3 to 32. The binder is mixed with a refractory mold raw material and then shaped to form a casting mold. The casting mold is cured by heating of the mold to temperatures of about 120° C. while blowing air through the assembly. The test molds produced in this way exhibit a high level of hot strength after removal from the mold, and also a high level of cold strength. A disadvantage in this case, however, are the initial strengths, which do not allow operationally reliable mass manufacture of cores to be ensured. The thermal stability as well is inadequate for application at temperatures above 500° C., especially in the case of molds which are subject to high thermal stresses.

On account of the above-discussed problem of the emissions that occur in the course of casting and are injurious to health, a concern is to replace the organic binders with inorganic binders in the production of casting molds, even in the case of complicated geometries. If, however, casting molds are produced which include very thin-walled segments, deformation of these thin-walled sections is often observed in the course of the casting operation. This can lead to deviations in the dimensions of the casting, which can no longer be compensated by subsequent machining. Consequently the casting becomes unusable. Thin-walled sections of the casting mold are subject to a higher thermal load in the course of casting than are thick-walled sections, and therefore tend more toward deformation. This problem occurs even with aluminum casting, where the temperatures that prevail, of about 650-750° C., are relatively low as compared with the casting of iron or steel. This becomes a particular problem when the liquid metal strikes the highly thermally loaded thin-walled sections at an inclined angle on introduction into the casting mold, and high mechanical forces act on the thin-walled sections as a result of the metallostatic pressure.

It was therefore an object of the invention to provide a molding mixture for producing casting molds for metalworking, which comprises at least one refractory mold raw material and a binder system which is based on water glass the molding mixture containing a proportion of a particulate metal oxide selected from the group consisting of silicon dioxide, aluminum oxide, titanium oxide and zinc oxide, and which makes it possible to produce casting molds which comprise thin-walled sections which do not show any deformation in metal casting.

This object is achieved by a molding mixture having the features of claim 1. Advantageous embodiments of the molding mixture of the invention are the subject matter of the dependent claims.

Surprisingly it has been found that, through the addition of a phosphorus-containing compound, it is possible to increase the strength of the casting mold to a point where even thin-walled sections can be realized that do not undergo any deformation in the course of metal casting. This is also the case when the liquid metal, in the course of casting, strikes the surface of the thin-walled sections of the casting mold at an angle, and, consequently, strong mechanical forces act on the thin-walled section of the casting mold. As a result it is even possible for casting molds of highly complex geometry to be produced using inorganic binders, and so the use of organic binders can be dispensed with for these applications.

The molding mixture of the invention for producing casting molds for metalworking comprises at least:

a refractory mold raw material;

a binder based on water glass; and a proportion of a particulate metal oxide selected from the group consisting of silicon dioxide, aluminum oxide, titanium oxide and zinc oxide.

According to the invention, the molding mixture contains a phosphorus-containing compound as further constituent.

As refractory mold raw material, it is possible to use materials customary for producing casting molds.

At the temperatures which prevail in the course of metal casting, the refractory mold raw material must have a sufficient dimensional stability. A suitable refractory mold raw material is therefore characterized by a high melting point. The melting point of the refractory mold raw material is preferably higher than 700° C., more preferably higher than 800° C., particularly preferably higher than 900° C., and with more particular preference higher than 1000° C. Suitable refractory mold raw materials are, for example, silica sand or zircon sand. Furthermore, fibrous refractory mold raw materials such as chamotte fibers are also suitable. Further suitable refractory mold raw materials are, for example, olivine, chromium ore sand, vermiculite.

Further materials which can be used as refractory mold raw materials are synthetic refractory mold raw materials such as hollow aluminum silicate spheres (known as microspheres), glass beads, glass granules or spherical ceramic mold raw materials known under the trade name "Cerabeads" or "Carboaccucast". The synthetic refractory mold raw materials are produce dsynthetically or are formed, for example, as waste in industrial processes. These spherical ceramic mold raw materials contain, for example, mullite, α-alumina, β-cristobalite in various proportions as minerals. They contain aluminum oxide and silicon dioxide as significant components. Typical compositions contain, for example, $Al_2O_3$ and $SiO_2$ in approximately equal proportions. In addition, further constituents can also be present in proportions of <10%, e.g. $TiO_2$, $Fe_2O_3$. The diameter of the spherical refractory mold raw materials is preferably less than 1000 μm, in particular less than 600 μm. Synthetically produced refractory mold raw materials such as mullite (x $Al_2O_3$.y $SiO_2$, where x=2 to 3, y=1 to 2; ideal formula: $Al_2SiO_5$) are also suitable. These synthetic mold raw materials are not derived from a natural source and can also have been subjected to a particular shaping process, as, for example, in the case of the production of hollow aluminum silicate microspheres, glass beads or spherical ceramic mold raw materials. Hollow aluminum silicate microspheres come about, for example, when fossil fuels or other combustible materials are burnt, and are separated from the ash that is formed in the course of the combustion. Hollow microspheres as an artificial refractory mold raw material are notable for a low specific weight. This goes back to the structure of these artificial refractory mold raw materials, which comprise gas-filled pores. These pores may be open or closed. It is preferred to use closed-pore artificial refractory mold raw materials. When open-pore artificial refractory mold raw materials are used, some of the binder based on water glass is taken into the pores and is then no longer able to develop a binding action.

According to one embodiment, glass materials are used as synthetic mold raw materials. These are, in particular, used either as glass spheres or as glass granules. As glass, it is possible to use conventional glasses, preferably glasses which have a high melting point. It is possible to use, for example, glass beads and/or glass granules produced from crushed glass. Borate glasses are likewise suitable. The composition of such glasses is indicated by way of example in the following table.

TABLE

Composition of glasses

| Constituent | Crushed glass | Borate glass |
|---|---|---|
| $SiO_2$ | 50-80% | 50-80% |
| $Al_2O_3$ | 0-15% | 0-15% |
| $Fe_2O_3$ | <2% | <2% |
| $M^{II}O$ | 0-25% | 0-25% |
| $M^{I}_2O$ | 5-25% | 1-10% |
| $B_2O_3$ | | <15% |
| Others | <10% | <10% |

$M^{II}$: Alkaline earth metal, e.g. Mg, Ca, Ba
$M^{I}$: Alkali metal, e.g. Na, K However, apart from the glasses given in the table, it is also possible to use other glasses whose contents of the abovementioned compounds are outside the ranges given. Likewise, it is also possible to use speciality glasses which contain other elements or oxides thereof in addition to the oxides mentioned.

The diameter of the glass spheres is preferably 1 to 1000 μm, preferably 5 to 500 μm and particularly preferably 10 to 400 μm.

Preferably only some of the refractory mold raw material is formed by glass materials. The proportion of the glass material among the total refractory mold raw material is chosen to be preferably less than 35% by weight, more preferably less than 25% by weight, with more particular preference less than 15% by weight.

In casting experiments using aluminum, it has been found that when synthetic mold raw materials, especially glass beads, glass granules or glass microspheres, are used, less mold sand remains adhering to the metal surface after casting than when pure silica sand is used. The use of such synthetic mold raw materials based on glass materials therefore makes it possible to produce smooth cast surfaces, so that complicated after-working by blasting is necessary to a significantly reduced extent, if at all.

In order to obtain the described effect of the generation of smooth cast surfaces, the proportion of the glass material as part of the total refractory mold raw material is chosen to be preferably greater than 0.5% by weight, more preferably greater than 1% by weight, with particular preference greater than 1.5% by weight, and with more particular preference greater than 2% by weight.

It is not necessary for the entire refractory mold raw material to be made up of the synthetic refractory mold raw materials. The preferred proportion of synthetic mold raw materials is at least about 3% by weight, particularly preferably at least 5% by weight, in particular at least 10% by weight, preferably at least about 15% by weight, particularly preferably at least about 20% by weight, based on the total amount of the refractory mold raw material. The refractory mold raw material is preferably capable of powder flow so that the molding mixture of the invention can be processed in conventional core shooting machines.

For reasons of cost, the proportion of the artificial refractory mold raw materials is minimized. The proportion of the artificial refractory mold raw materials among the total refractory mold raw material is preferably less than 80% by weight, more preferably less than 75% by weight, particularly preferably less than 65% by weight.

As further component, the molding mixture of the invention comprises a binder based on water glass. As water glass, it is possible to use conventional water glasses as have hitherto been used as binders in molding mixtures. These water glasses comprise dissolved sodium or potassium silicates and can be prepared by dissolving vitreous potassium and sodium silicates in water. The water glass preferably has an $SiO_2/M_2O$ ratio in the range from 1.6 to 4.0, in particular from 2.0 to 3.5, where M is sodium and/or potassium. The water glasses preferably have a solids content in the range from 30 to 60% by weight. The solids content is based on the amount of $SiO_2$ and $M_2O$ present in the water glass.

The molding mixture further contains a proportion of a particulate metal oxide selected from the group consisting of silicon dioxide, aluminum oxide, titanium dioxide and zinc oxide. The average primary particle size of the particulate metal oxide can be between 0.10 μm and 1 μm. Because of the agglomeration of the primary particles, however, the particle size of the metal oxides is preferably less than 300 μm, preferably less than 200 μm, particularly preferably less than 100 μm. It is preferably in the range from 5 to 90 μm, particularly preferably 10 to 80 μm and very particularly preferably in the range from 15 to 50 μm. The particle size can be determined by sieve analysis, for example. The sieve residue left on a sieve having a mesh opening of 63 μm is particularly preferably less than 10% by weight, more preferably less than 8% by weight.

As particulate metal oxide, particular preference is given to using silicon dioxide, particularly preferably synthetic amorphous silicon dioxide.

As particulate silicon dioxide, preference is given to using precipitated silica and/or pyrogenic silica. Precipitated silica is obtained by reaction of an aqueous alkali metal silicate solution with mineral acids. The precipitate obtained is subsequently separated off, dried and milled. For the purposes of the present invention, pyrogenic silicas are silicas which are obtained by coagulation from the gas phase at high temperatures. Pyrogenic silica can be produced, for example, by flame hydrolysis of silicon tetrachloride or in an electric arc furnace by reduction of silica sand by means of coke or anthracite to form silicon monoxide gas followed by oxidation to silicon dioxide. The pyrogenic silicas produced by the electric arc furnace process can still contain carbon. Precipitated silica and pyrogenic silica are equally suitable for the molding mixture of the invention. These silicas will hereinafter be referred to as "synthetic amorphous silicon dioxide".

The inventors assume that the strongly alkaline water glass can react with the silanol groups present on the surface of the synthetic amorphous silicon dioxide and that evaporation of the water results in formation of a strong bond between the silicon dioxide and the then solid water glass.

As an essential further component, the molding mixture of the invention comprises a phosphorus-containing compound. In this context it is possible per se to use both organic and inorganic phosphorus compounds. In order not to initiate any unwanted side reactions in the course of metal casting, it is further preferred that the phosphorus in the phosphorus-containing compounds is present preferably in the V oxidation state.

The phosphorus-containing compound here is present preferably in the form of a phosphate or phosphorus oxide. The phosphate may be present in the form of alkali metal or alkaline earth metal phosphate, particular preference being given to alkali metal salts and, of these, especially the sodium salts. Per se it is also possible to use ammonium phosphates or phosphates of other metal ions. The alkali and also, where appropriate, alkaline earth metal phosphates stated as being preferred, however, are readily obtainable and available inexpensively in any desired amounts. Phosphates of polyvalent metal ions, especially trivalent metal ions, are not preferred. It has been observed that, when such phosphates of polyvalent metal ions, especially trivalent metal ions, are used, the processing life of the molding mixture is shortened.

Where the phosphorus-containing compound is added to the molding mixture in the form of a phosphorus oxide, the phosphorus oxide is present preferably in the form of phosphorus pentoxide. It is also possible, however, for phosphorus trioxide and phosphorus tetroxide to be used.

In one further embodiment the molding mixture may be admixed with the phosphorus-containing compound in the form of the salts of fluorophosphoric acids. Particularly preferred in this context are the salts of monofluorophosphoric acid. The sodium salt is especially preferred.

In accordance with one preferred embodiment the molding mixture is admixed with organic phosphates as phosphorus-containing compound. Preference is given here to alkyl phosphates or aryl phosphates. The alkyl groups in this case contain preferably 1 to 10 carbon atoms and may be straight-chain or branched. The aryl groups contain preferably 6 to 18 carbon atoms, and the aryl groups may also be substituted by alkyl groups. Particularly preferred phosphate compounds are those which derive from monomeric or polymeric carbohydrates such as glucose, cellulose or starch, for instance. The use of a phosphorus-containing organic component as an additive is advantageous in two respects. First, the phosphorus component allows the necessary thermal stability of the casting mold to be achieved, and secondly the organic component is beneficial to the surface quality of the corresponding casting.

Phosphates which can be used include orthophosphates and also polyphosphates, pyrophosphates or metaphosphates. The phosphates may be prepared, for example, by neutralizing the corresponding acids with a corresponding base, an alkali metal base, for example, such as NaOH, or else, where appropriate, an alkaline earth metal base; it is not absolutely necessary for all of the negative charges of the phosphate ions to be satisfied by metal ions. Not only the metal phosphates but also the metal hydrogenphosphates and also the metal dihydrogenphosphates can be used, such as $Na_3PO_4$, $Na_2HPO_4$ and $NaH_2PO_4$, for example. Moreover, the anhydrous phosphates and also hydrates of phosphates can be used. The phosphates may be introduced into the molding mixture both in crystalline form and in amorphous form.

By polyphosphates are meant more particularly linear phosphates which comprise more than one phosphorus atom, the phosphorus atoms each being joined via oxygen bridges. Polyphosphates are obtained by condensing orthophosphate ions with elimination of water, to give a linear chain of $PO_4$ tetrahedra each joined via corners. Polyphosphates have the general formula $(O(PO_3)_n)^{(n+2)-}$, where n corresponds to the chain length. A polyphosphate may comprise up to several hundred $PO_4$ tetrahedra. Preference, however, is given to using polyphosphates with shorter chain lengths. Preferably n has values of 2 to 100, more preferably 5 to 50. It is also possible to use polyphosphates with higher degrees of condensation, i.e., polyphosphates in which the $PO_4$ tetrahedra are joined to one another via more than two corners and which therefore exhibit polymerization in two or three dimensions.

Metaphosphates are understood as being cyclic structures composed of $PO_4$ tetrahedra each joined via corners. Metaphosphates have the general formula $((PO_3)_n)^{n-}$, where n is at least 3. Preferably n has values of 3 to 10.

It is possible to use not only individual phosphates but also mixtures of different phosphates and/or phosphorus oxides.

The preferred proportion of the phosphorus-containing compound, based on the refractory mold raw material, is between 0.05 and 1.0% by weight. In the case of a proportion of less than 0.05% by weight, there is no significant influence found on the dimensional stability of the casting mold. Where the proportion of the phosphate exceeds 1.0% by weight, there is a sharp reduction in the hot strength of the casting mold. The proportion of the phosphorus-containing compound that is selected is preferably between 0.10 and 0.5% by weight. The phosphorus-containing compound contains preferably between 0.5 and 90% by weight of phosphorus, calculated as $P_2O_5$. Where inorganic phosphorus compounds are used, they contain preferably 40 to 90% by weight, more preferably 50 to 80% by weight, of phosphorus, calculated as $P_2O_5$. Where organic phosphorus compounds are used, they contain preferably 0.5 to 30% by weight, more preferably 1 to 20% by weight, of phosphorus, calculated as $P_2O_5$.

The phosphorus-containing compound may per se be added in solid or dissolved form to the molding mixture. The phosphorus-containing compound is preferably added to the molding mixture in the form of a solid. Where the phosphorus-containing compound is added in dissolved form, water is the preferred solvent.

As a further advantage of the addition of phosphorus-containing compounds to molding mixtures for the purpose of producing casting molds, it has been found that the molds exhibit very good disintegration after metal casting. This applies to metals which require relatively low casting temperatures, such as light alloy metals, especially aluminum. However, better disintegration of the casting mold in the case of iron casting has been found as well. In iron casting, relatively high temperatures of more than 1200° C. act on the casting mold, and so there is an increased risk of vitrification of the casting mold and hence a deterioration in the disintegration properties.

In the context of the investigations carried out by the inventors on the stability and the disintegration of casting molds, iron oxide as well was considered as a possible additive. When iron oxide is added to the molding mixture, there is likewise an increase observed in the stability of the casting mold in metal casting. Through the addition of iron oxide, therefore, it is possible potentially to achieve likewise an improvement in the stability of thin-walled sections of the casting mold. However, the addition of iron oxide does not produce the improvement in the disintegration properties of the casting mold after metal casting, especially iron casting, that is observed when phosphorus-containing compounds are added.

The molding mixture of the invention is an intimate mixture of at least the constituents mentioned. Here, the particles of the refractory mold raw material are preferably coated with a layer of the binder. Firm cohesion between the particles of the refractory mold raw material can then be achieved by evaporation of the water present in the binder (about 40-70% by weight, based on the weight of the binder).

The binder, i.e. the water glass and the particulate metal oxide, in particular synthetic amorphous silicon dioxide, and the phosphate is preferably present in a proportion of less than 20% by weight in the molding mixture. The proportion of the binder relates in this case to the solids content of the binder. If massive refractory mold raw materials, for example silica sand, are used, the binder is preferably present in a proportion of less than 10% by weight, preferably less than 8% by weight, particularly preferably less than 5% by weight. If refractory mold raw materials which have a low density, for example the above-described hollow microspheres, are used, the proportion of binder increases correspondingly.

The particulate metal oxide, in particular the synthetic amorphous silicon dioxide, is, based on the total weight of the binder, preferably present in a proportion of from 2 to 80% by weight, more preferably from 3 to 60% by weight, particularly preferably from 4 to 50% by weight.

The ratio of water glass to particulate metal oxide, in particular synthetic amorphous silicon dioxide, can be varied within a wide range. This offers the advantage that the initial strength of the casting mold, i.e. the strength immediately after removal from the hot tool, and the moisture resistance can be improved without the final strengths, i.e. the strengths after cooling of the casting mold, compared to a water glass binder without amorphous silicon dioxide being significantly affected. This is of especially great interest in light metal casting. On the one hand, high initial strengths are desirable in order to allow the casting mold produced to be transported without problems or be assembled with other casting molds, but on the other hand the final strength after curing should not be too high in order to avoid difficulties with binder decomposition after casting, i.e. the mold raw material should be able to be removed without problems from hollow spaces of the cast body after casting.

The mold raw material present in the molding mixture of the invention can, in one embodiment of the invention, contain at least a proportion of hollow microspheres. The diameter of the hollow microspheres is normally in the range from 5 to 500 μm, preferably in the range from 10 to 350 μm, and the thickness of the shell is usually in the range from 5 to 15% of the diameter of the microspheres. These microspheres have a very low specific gravity, so that the casting molds produced using hollow microspheres have a low weight. The insulating action of the hollow microspheres is particularly advantageous. The hollow microspheres are therefore used for the production of casting molds particularly when these are to have an increased insulating action. Such casting molds are, for example, the feeders described at the outset, which act as equilibration reservoir and contain liquid metal, with the intention being that the metal is held in a liquid state until the metal introduced into the hollow mold has solidified. Another field of application for casting molds containing hollow microspheres is, for example, sections of a casting mold which correspond to particularly thin-walled sections of the finished casting. The insulating action of the hollow microspheres ensures that the metal does not solidify prematurely in the thin-walled sections and thus blocks the paths within the casting mold.

If hollow microspheres are used, the binder is, due to the low density of these hollow microspheres, preferably used in a proportion of preferably less than 20% by weight, particularly preferably in a proportion of from 10 to 18% by weight. The values are based on the solids content of the binder.

The hollow microspheres preferably have sufficient temperature stability that they do not soften prematurely and lose their shape in metal casting. The hollow microspheres preferably comprise an aluminum silicate. These hollow aluminum silicate microspheres preferably have an aluminum oxide content of more than 20% by weight, but can also have a content of more than 40% by weight. Such hollow microspheres are marketed, for example, by Omega Minerals Germany GmbH, Norderstedt, under the trade names Omega-Spheres® SG having an aluminum oxide content of about 28-33%, Omega-Spheres® WSG having an aluminum oxide content of about 35-39% and E-Spheres® having an aluminum oxide content of about 43%. Corresponding products are obtainable from PQ Corporation (USA) under the trade name "Extendospheres®".

In a further embodiment, hollow microspheres made up of glass are used as refractory mold raw material.

In a preferred embodiment, the hollow microspheres comprise a borosilicate glass. The borosilicate glass has a proportion of boron, calculated as $B_2O_3$ of more than 3% by weight. The proportion of hollow microspheres is preferably less than 20% by weight, based on the molding mixture. When hollow borosilicate glass microspheres are used, a low proportion is preferably chosen. This is preferably less than 5% by weight, more preferably less than 3% by weight and particularly preferably in the range from 0.01 to 2% by weight.

As mentioned above, the molding mixture of the invention contains, in a preferred embodiment, at least a proportion of glass granules and/or glass beads as refractory mold raw material.

It is also possible to produce the molding mixture as an exothermic molding mixture which is, for example, suitable for producing exothermic feeders. For this purpose, the molding mixture contains an oxidizable metal and a suitable oxidant. Based on the total mass of the molding mixture, the oxidizable metals are preferably present in a proportion of from 15 to 35% by weight. The oxidant is preferably added in a proportion of from 20 to 30% by weight, based on the molding mixture. Suitable oxidizable metals are, for example, aluminum and magnesium. Suitable oxidants are, for example, iron oxide and potassium nitrate.

Binders which contain water have a poorer flowability than binders based on organic solvents. The flowability of the molding mixture can be further deteriorated by the addition of the particulate metal oxide. This means that molding tools having narrow passages and a number of bends can be filled less readily. As a consequence, the casting molds have sections with unsatisfactory consolidation, which in turn can lead to casting defects in casting. In an advantageous embodiment, the molding mixture of the invention contains a proportion of a lubricant, preferably of a platelet-like lubricant, in particular graphite, $MoS_2$, talc and/or pyrophyllite. It has surprisingly been found that when such lubricants, in particular graphite, are added, even complex shapes having thin-walled sections can be produced, with the casting molds having a uniformly high density and strength throughout, so that essentially no casting defects were observed in casting. The amount of platelet-like lubricant, in particular graphite, added is preferably from 0.05% by weight to 1% by weight, based on the refractory mold raw material.

Apart from the abovementioned constituents, the molding mixture of the invention can comprise further additives. For example, it is possible to add internal mold release agents which aid detachment of the casting molds from the molding tool. Suitable internal mold release agents are, for example, calcium stearate, fatty acid esters, waxes, natural resins or specific alkyd resins. Furthermore, silanes can also be added to the molding mixture of the invention.

In a preferred embodiment, the molding mixture of the invention therefore contains an organic additive which has a melting point in the range from 40 to 180° C., preferably from 50 to 175° C., i.e. is solid at room temperature. For the present purposes, organic additives are compounds whose molecular skeleton is made up predominantly of carbon atoms, i.e., for example, organic polymers. The addition of the organic additives enables the quality of the surface of the casting to be improved further. The mode of action of the organic additives has not been elucidated. However, without wishing to be tied to this theory, the inventors assume that at least part of the organic additives burns during the casting process and a thin gas cushion between the liquid metal and the mold raw material forming the wall of the casting mold is produced, thus preventing a reaction between the liquid metal and the mold raw material. Furthermore, the inventors assume that part of the organic additives forms a thin layer of glossy carbon under the reducing atmosphere prevailing during casting and this likewise prevents a reaction between metal and mold raw material. A further advantageous effect which can be achieved by addition of the organic additives is an increase in the strength of the casting mold after curing.

The organic additives are preferably added in an amount of from 0.01 to 1.5% by weight, in particular from 0.05 to 1.3% by weight, particularly preferably from 0.1 to 1.0% by weight, in each case based on the refractory mold raw material. To avoid strong smoke development during metal casting, the proportion of organic additives is usually selected to be less than 0.5% by weight.

It has surprisingly been found that an improvement in the surface of the casting can be achieved by means of very different organic additives. Suitable organic additives are, for example, phenol-formaldehyde resins such as novolaks, epoxy resins such as bisphenol A epoxy resins, bisphenol F epoxy resins or epoxidized novolaks, polyols such as polyethylene glycols or polypropylene glycols, polyolefins such as polyethylene or polypropylene, copolymers of olefins such as ethylene or propylene and further comonomers such as vinyl acetate, polyamides such as polyamide-6, polyamide-12 or polyamide-6,6, natural resins such as balsam resin, fatty acids such as stearic acid, fatty acid esters such as cetyl palmitate, fatty acid amides such as ethylenediamine-bisstearamide, monomeric or polymeric carbohydrate compounds such as glucose or cellulose, and their derivatives such as methyl, ethyl or carboxymethylcellulose, and also metal soaps such as stearates or oleates of monovalent to trivalent metals. The organic additives can be present either as pure substances or as a mixture of various organic compounds.

In a further preferred embodiment, the molding mixture of the invention contains a proportion of at least one silane. Suitable silanes are, for example, aminosilanes, epoxysilanes, mercaptosilanes, hydroxysilanes, methacrylosilanes, ureidosilanes and polysiloxanes. Examples of suitable silanes are γ-aminopropyltrimethoxysilane, γ-hydroxypropyltrimethoxysilane, 3-ureidopropyltriethoxysilane, γ-mercaptopropyltrimethoxysilane, γ-glycidoxypropyltrimethoxysilane,β-(3,4-epoxycyclohexyl)trimethoxysilane, 3-methacryloyloxypropyltrimethoxysilane and N-β-(aminoethyl)-γ-aminopropyltrimethoxysilane.

Based on the particulate metal oxide, it is typically made of about 5-50% by weight of silane, preferably about 7-45% by weight, particularly preferably about 10-40% by weight.

Despite the high strengths which can be achieved using the binder according to the invention, the casting molds produced using the molding mixture of the invention, in particular cores and molds, surprisingly display good disintegration after casting, in particular in the case of aluminum casting. As already explained, it has also been found that casting molds which also have very good disintegration in iron casting can be produced using the molding mixture of the invention, so that the molding mixture can easily flow back out of even narrow and angled sections of the casting mold after casting. Therefore, the use of the shaped bodies produced from the molding mixture of the invention is not restricted to light metal casting. The casting molds are suitable in general for the casting of metals. Such metals are, for example, nonferrous metals such as brass or bronzes and also ferrous metals.

The invention further provides a process for producing casting molds for metalworking, in which the molding mixture of the invention is used. The process of the invention comprises the steps:

production of the above-described molding mixture;

molding of the molding mixture;

curing of the molded molding mixture by heating the molding mixture to give the cured casting mold.

In the production of the molding mixture of the invention, the refractory mold raw material is usually firstly placed in a mixing vessel and the binder is then added while stirring. The water glass and the particulate metal oxide, in particular the synthetic amorphous silicon dioxide, and the phosphate can in principle be added in any order. In accordance with one preferred embodiment, the binder is provided in the form of a two-component system, a first, liquid component comprising the water glass, and a second, solid component comprising the particulate metal oxide, the phosphate and also, where appropriate, a lubricant—preferably a platelet-form lubricant—and/or an organic component. For the preparation of the molding mixture, the refractory mold raw material is charged to a mixer and then preferably first the solid component of the binder is added and is mixed with the refractory mold raw material. The duration of mixing is selected such that intimate mixing takes place between the refractory mold raw material and solid binder component. The duration of mixing is dependent on the amount of molding mixture to be prepared, and also on the mixing assembly used. Preferably the selected duration of mixing is between 1 and 5 minutes. With preferably further agitation of the mixture, the liquid component of the binder is then added, and mixing of the mixture is continued until a uniform layer of the binder has formed on the particles of the refractory mold raw material. Here as well the duration of mixing is dependent on the amount of molding mixture to be prepared, and also on the mixing assembly used. The duration for the mixing procedure is preferably selected at between 1 and 5 minutes.

Alternatively, in accordance with another embodiment, the liquid component of the binder can be added first to the refractory mold raw material, followed only then by the supplying of the solid component of the mixture. In accordance with a further embodiment, first from 0.05 to 0.3% of water, based on the weight of the mold raw material, is added to the refractory mold raw material, and only then are the solid and liquid components of the binder added. With this embodiment it is possible to obtain a surprising positive effect on the processing time of the molding mixture. The inventors assume that the water-removing effect of the solid components of the binder is reduced in this way, thereby delaying the curing process.

The molding mixture is subsequently brought to the desired shape. Conventional methods are used for molding. For example, the molding mixture can be shot into the molding tool with the aid of compressed air by means of a core shooting machine. The molding mixture is subsequently cured by heating in order to vaporize the water present in the binder. On heating, water is removed from the molding mixture. The removal of water is presumed also to initiate condensation reactions between silanol groups, so that crosslinking of the water glass begins. The cold curing processes that are described in the prior art have the effect, for example, through introduction of carbon dioxide or through polyvalent metal cations, of precipitating compounds of low solubility and hence of solidification of the casting mold.

Heating of the molding mixture can, for example, be carried out in the molding tool. It is possible to cure the casting mold completely in the molding tool, but it is also possible to cure only the surface region of the casting mold so that it has sufficient strength to be able to be taken from the molding tool. The casting mold can then be cured completely by withdrawing further water from it. This can be effected, for example, in an oven. The withdrawal of water can, for example, also be effected by evaporating the water under reduced pressure.

The curing of the casting molds can be accelerated by blowing heated air into the molding tool. In this embodiment of the process, rapid removal of the water present in the binder is achieved, as a result of which the casting mold is strengthened within periods of time suitable for industrial use. The temperature of the air blown in is preferably from 100° C. to 180° C., particularly preferably from 120° C. to 150° C. The flow rate of the heated air is preferably set so that curing of the casting mold occurs within periods of time suitable for industrial use. The periods of time depend on the size of the casting molds produced. Curing in a time of less than 5 minutes, preferably less than 2 minutes, is sought. However, in the case of very large casting molds, longer periods of time can also be necessary.

The removal of the water from the molding mixture can also be effected by heating the molding mixture by irradiation with microwaves. However, the irradiation with microwaves is preferably carried out after the casting mold has been taken from the molding tool. However, the casting mold has to have achieved a sufficient strength to allow this. As mentioned above, this can be achieved, for example, by at least an outer shell of the casting mold being cured in the molding tool.

The thermal curing of the molding mixture with removal of water avoids the problem of subsequent solidification of the casting mold in the course of metal casting. The cold curing processes described in the prior art, in which carbon dioxide is passed through the molding mixture, entail precipitation of carbonates from the water glass. In the cured casting mold, however, there remains a relatively large amount of bound water, which is then expelled in the course of metal casting and leads to a very high level of solidification of the casting mold. Furthermore, casting molds solidified by introduction of carbon dioxide do not attain the same stability as casting molds cured thermally by removal of water. The formation of carbonates disrupts the structure of the binder, which therefore loses strength. With cold-cured casting molds based on water glass, therefore, it is not possible to produce thin sections of a casting mold which if appropriate also have a complex geometry. Casting molds cured cold by introduction of carbon dioxide are therefore not suitable for the preparation of castings having a highly complex geometry and narrow passages with a plurality of diversions, such as oil channels in combustion engines, since the casting mold does not attain the requisite stability and it is extremely difficult to remove the casting mold completely from the casting after metal casting has taken place. In the course of thermal curing, the water is largely removed from the casting mold, and, on metal casting, a significantly lower after-curing of the casting mold is observed. After metal casting has taken place, the casting mold exhibits substantially better disintegration than casting molds cured by introduction of carbon dioxide. By virtue of the thermal curing it is even possible to produce casting molds which are suitable for the manufacture of castings having a highly complex geometry and narrow passages.

As indicated above, the flowability of the molding mixture of the invention can be improved by addition of, preferably platelet-like, lubricants, in particular graphite and/or $MoS_2$ and/or talc. Minerals similar to talc, such as pyrophyllite, can also improve the flowability of the molding mixture. In production of the molding mixture, the platelet-like lubricant, in particular graphite and/or talc, can be added separately from the two binder components to the molding mixture. However, it is equally possible to premix the platelet-like lubricant, in particular graphite, with the particulate metal oxide, in particular the synthetic amorphous silicon dioxide, and only then mix with the water glass and the refractory mold raw material.

If the molding mixture comprises an organic additive, the addition of the organic additive can in principle be effected at any point in time during the production of the molding mixture. The organic additive can be added as such or in the form of a solution.

Water-soluble organic additives can be used in the form of an aqueous solution. If the organic additives are soluble in the binder and are stable in this without decomposition for a number of months, they can also be dissolved in the binder and thus added together with this to the mold raw material. Water-insoluble additives can be used in the form of a dispersion or a paste. The dispersions or pastes preferably contain water as dispersant. Solutions or pastes of the organic additives can in principle also be produced in organic dispersant. However, if a solvent is used for the addition of the organic additives, preference is given to using water.

The organic additives are preferably added as powders or short fibers, with the mean particle size or the fiber length preferably being chosen so that it does not exceed the size of the refractory mold raw material particles. The organic additives can particularly preferably pass through a sieve having a mesh opening of about 0.3 mm. To reduce the number of components added to the refractory mold raw material, the particulate metal oxide and the organic additive or additives are preferably not added separately to the mold sand but are mixed beforehand.

If the molding mixture contains silanes or siloxanes, the silanes are usually incorporated into the binder before being added. The silanes or siloxanes can also be added as separate component to the mold raw material. However, it is particularly advantageous to silanize the particulate metal oxide, i.e. mix the metal oxide with the silane or siloxane, so that its surface is provided with a thin silane or siloxane layer. When the particulate metal oxide which has been pretreated in this way is used, increased strengths and also improved resistance to high atmospheric humidity compared to the untreated metal oxide are found. If, as described, an organic additive is added to the molding mixture or the particulate metal oxide, it is advantageous to do this before silanization.

The process of the invention is in principle suitable for producing all casting molds customary for metal casting, i.e., for example, cores and molds. Casting molds which comprise very thin-walled sections can also be produced particularly advantageously in this case. Particularly when an insulating refractory mold raw material is added or exothermic materials are added to the molding mixture of the invention, the process of the invention is suitable for producing feeders.

The casting molds produced from the molding mixture of the invention or by means of the process of the invention have a high strength immediately after they have been produced, without the strength of the casting molds after curing being so high that difficulties occur in removal of the casting mold after production of the casting. It has been found here that the casting mold has very good disintegration properties both in light metal casting, in particular aluminum casting, and in iron casting. Furthermore, these casting molds have a high stability in the presence of a relatively high atmospheric humidity, i.e. the casting molds can surprisingly be stored without problems even for a relatively long time. A particular advantage of the casting mold is very high stability at mechanical load, so that thin-walled sections of the casting mold can also be realized without them being deformed by the metallostatic pressure in the casting process. The invention therefore further provides a casting mold which has been obtained by the above-described process of the invention.

The casting mold of the invention is generally suitable for metal casting, in particular light metal casting. Particularly advantageous results are obtained in aluminum casting.

The invention is illustrated below with the aid of examples and with reference to the accompanying figures. In the figures:

FIG. 1 shows a schematic construction of a BCIRA Hot Distortion Apparatus (G. C. Fountaine, K. B. Horton, "Hot Distortion of Cold-Box Sands", Giesserei-Praxis, No. 6, pp. 85-93, 1992)

Figure 2:
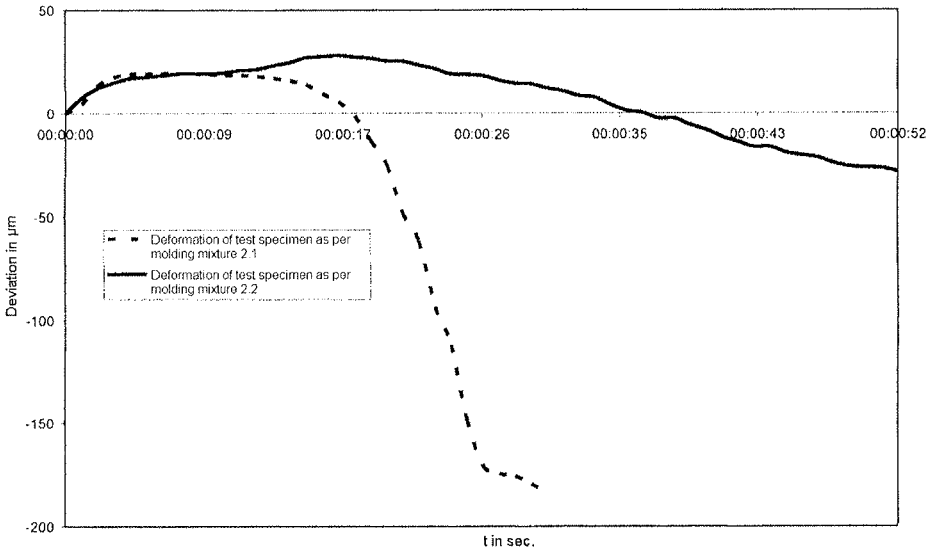
Figure 3A:
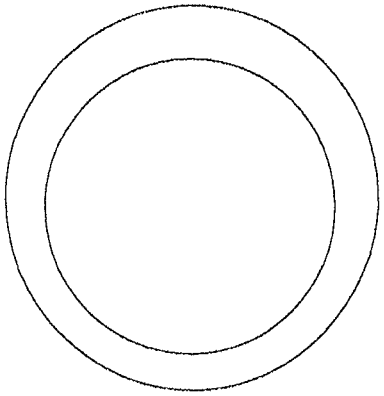
Figure 3B:
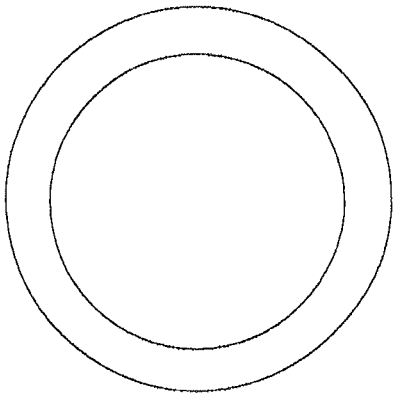

FIG. 2: shows a diagram of the BCIRA Hot Distortion Test of a phosphate-containing test specimen and of a test specimen without a phosphate fraction (Morgan, A. D., Fasham E. W., "The BCIRA Hot Distortion Tester for Quality Control in Production of Chemically Bonded Sands, AFS Transactions, vol. 83, pp. 73-80 (1975);

FIG. 3A: shows a schematic reproduction of a section of a casting, the casting mold having been produced in one case without phosphates; and FIG. 3B: shows a schematic reproduction of a section of a casting, in one case with addition of phosphates.

EXAMPLE 1

Influence of synthetic amorphous silicon dioxide and phosphorous components on the strength of shaped bodies using silica sand as mold raw material.

1. Production and Testing of the Molding Mixture

To test the molding mixture, Georg-Fischer test bars were produced. Georg-Fischer test bars are cuboidal test bars having the dimensions 150 mm×22.36 mm×22.36 mm.

The composition of the molding mixture is indicated in Table 1. To produce the Georg-Fischer test bars, the following procedure was employed:

The components indicated in Table 1 were mixed in a laboratory blade mixer (from Vogel & Schemmann AG, Hagen, Germany). For this purpose, the silica sand was firstly placed in the mixer and the water glass was added while stirring. A sodium water glass having proportions of potassium was used as water glass. The $SiO_2$:$M_2O$ ratio, where M is the sum of sodium and potassium, is therefore indicated in the following tables. After the mixture had been stirred for one minute, the amorphous silicon dioxide if used and/or the phosphorus component was added while continuing to stir. The mixture was subsequently stirred for a further one minute;

The molding mixtures were transferred to the stock hopper of an H 2.5 hot box core shooting machine from Röperwerk—Gießereimaschinen GmbH, Viersen, Germany, whose molding tool had been heated to 200° C.;

The molding mixtures were introduced into the molding tool by means of compressed air (5 bar) and remained in the molding tool for a further 35 seconds;

To accelerate curing of the mixtures, hot air (2 bar, 120° C. at the inlet into the tool) was passed through the molding tool for the last 20 seconds;

The molding tool was opened and the test bars were taken out.

To determine the flexural strengths, the test bars were placed in a Georg-Fischer strength testing apparatus equipped with a 3-point bending rig (DISA Industrie AG, Schaffhausen, CH) and the force which led to fracture of the test bars was measured.

The flexural strengths were measured according to the following scheme:

- 10 seconds after removal from the molding tool (hot strengths)
- 1 hour after removal from the molding tool (cold strengths)
- storage of the cooled cores for 3 hours in a controlled-atmosphere cabinet at 25° C. and 75% relative atmospheric humidity.

TABLE 1

Composition of the molding mixtures

| | Silica sand H32 | Alkali metal water glass | Amorphous silicon dioxide | Phosphate | |
|---|---|---|---|---|---|
| 1.1 | 100 pbw | 2.0 [a)] | | | Comparison, not according to the invention |
| 1.2 | 100 pbw | 2.0 [a)] | 0.5 [b)] | | Comparison, not according to the invention |
| 1.3 | 100 pbw | 2.0 [a)] | | 0.3 [c)] | Comparison, not according to the invention |
| 1.4 | 100 pbw | 2.0 [a)] | 0.5 [b)] | 0.3 [c)] | According to the invention |
| 1.5 | 100 pbw | 2.0 [a)] | 0.5 [b)] | 0.1 [c)] | According to the invention |
| 1.6 | 100 pbw | 2.0 [a)] | 0.5 [b)] | 0.5 [c)] | According to the invention |
| 1.7 | 100 pbw | 2.0 [a)] | | 0.3 [c)] | Comparison, not according to the invention |
| 1.8 | 100 pbw | 2.0 [a)] | 0.5 [b)] | 0.3 [c)] | According to the invention |

[a)] Alkali metal water glass having an $SiO_2$:$M_2O$ ratio of about 2.3

[b)] Elkem Microsilica 971 (pyrogenic silica; produced in an electric arc furnace)

[c)] Sodium hexametaphosphate (Fluka), added as solid

[d)] Metakorin ® TWP 15 (polyphosphate solution from Metakorin Wasser-Chemie GmbH)

TABLE 2

Flexural strengths

| | Hot strengths [N/cm$^2$] | Cold strengths [N/cm$^2$] | After storage in a controlled-atmosphere cabinet [N/cm$^2$] | |
|---|---|---|---|---|
| 1.1 | 70 | 420 | 20 | Comparison, not according to the invention |
| 1.2 | 170 | 500 | 400 | Comparison, not according to the invention |
| 1.3 | 60 | 410 | 20 | Comparison, not according to the invention |
| 1.4 | 160 | 490 | 390 | According to the invention |
| 1.5 | 170 | 500 | 400 | According to the invention |
| 1.6 | 150 | 460 | 350 | According to the invention |
| 1.7 | 80 | 430 | 30 | Comparison, not according to the invention |
| 1.8 | 160 | 450 | 380 | According to the invention |

2. Result

Influence of the Amount of Amorphous Silicon Dioxide and Phosphate Added

All of the molding mixtures were prepared with a constant amount of molding material and of water glass. Examples 1.3 and 1.7 show that it is not possible to produce storable cores through the addition of phosphate alone. In Examples 1.2, 1.4, 1.5, 1.6 and 1.8 molding mixtures were prepared using amorphous silicon oxide. The hot strengths and strengths after storage in a controlled-atmosphere cabinet are much higher than for the other examples. Examples 1.4, 1.5 and 1.8 show that the hot strengths and cold strengths and also the strengths after storage in a controlled-atmosphere cabinet of molding materials comprising amorphous silicon dioxide as a constituent are not adversely affected by the addition of a phosphate-containing component. This means that the test bars produced using the molding mixture of the invention substantially retain their strengths even after prolonged storage. Example 1.6 suggests that, above a certain level of phosphate in the molding mixture, an adverse effect on the strengths is likely.

EXAMPLE 2

1. Measurement of Deformation

The deformation under thermal load was determined by the BCIRA Hot Distortion Test (Morgan, A. D., Fasham E. W., "The BCIRA Hot Distortion Tester for Quality Control in Production of Chemically Bonded Sands, AFS Transactions, vol. 83, pp. 73-80 (1975)).

In the BCIRA Hot Distortion Test, which is shown in FIG. 1, a sample body of chemically bonded sand with dimensions of 25×6×114 mm is clamped in as a cantilever and is heated on the flat side from below (G. C. Fountaine, K. B. Horton, "Hot Distortion of Cold-Box Sands", Giesserei-Praxis, No. 6, pp. 85-93, 1992). As a result of this one-sided heating, the sample body bends upward toward the cold side as a result of the thermal expansion of the hot side. This movement on the part of the sample body is identified in the graph as the "maximum expansion". To the extent that the sample body undergoes heating overall, the binder begins to disintegrate and to undergo transition to the thermoplastic state. On account of the thermoplastic properties of the various binder systems, the load through the load arm presses the sample body back downward again. This downward movement along the ordinate in the 0 line to the point of fracture is referred to as "hot distortion". The time which has lapsed between the beginning of the maximum expansion on the graph, and the point of fracture, is identified as the "time to fracture" and represents a further parameter. The movement that occurs in this experimental system can in fact be observed in molds and cores.

The molding mixtures were prepared in accordance with the method shown in Example 1, with the difference that the dimensions of the test bars were 25 mm×6 mm×114 mm.

TABLE 3

Composition of the molding mixtures

| | Silica sand H32 | Alkali metal water glass | Amorphous silicon dioxide | Phosphate | |
|---|---|---|---|---|---|
| 2.1 | 100 pbw | 2.0 [a)] | 0.5 [b)] | | Comparison, not according to the invention |
| 2.2 | 100 pbw | 2.0 [a)] | 0.5 [b)] | 0.3 [c)] | Comparison, not according to the invention |

[a)] Alkali metal water glass having an $SiO_2$:$M_2O$ ratio of about 2.3

[b)] Elkem Microsilica 971 (pyrogenic silica; produced in an electric arc furnace)

[c)] Sodium hexametaphosphate (Fluka), added as solid

2. Results

The measurements for the deformation under thermal load are shown in FIG. 2. Without addition of phosphate (molding mixture 2.1) the test specimen is deformed after just a short period of thermal load. Test specimens produced using molding mixture 2.2, in contrast, exhibit a significantly improved thermal stability. Through the addition of phosphate it is possible to extend the time until "hot distortion" takes place and hence the "time to fracture".

EXAMPLE 3

Production of Casting Molds Using Phosphate-Free and Phosphate-Containing Shaped Bodies In order to investigate the improved thermal stability of shaped bodies that was shown in Example 2, cores were produced using the molding mixtures 2.1 and 2.2. These cores were tested for their thermal stability in a casting operation (aluminum alloy, approx. 735° C.). Here it was found that a circular segment of the shaped body was correctly reproduced in the corresponding casting mold (FIG. 3*b*) only in the case of molding mixture 2.2. Without the addition of the phosphate component, elliptical deformations were observed on the casting mold, shown schematically in FIG. 3*a*.

From this it is evident that through the use of the molding mixture of the invention it is possible to lower the deformation tendency of shaped bodies during the casting operation and hence to improve the casting quality of corresponding casting molds.

The invention claimed is:

1. A process for casting nonferrous metals including light metals, which comprises the steps:

producing a molding mixture by bringing together at least:

a refractory mold raw material;

a binder based on water glass;

a particulate metal oxide comprising amorphous silicon dioxide; and 0.05 to 0.5% by weight, based on the refractory mold raw material, of a phosphorus-containing compound, wherein the phosphorus-containing compound is selected from the group consisting of sodium metaphosphate, sodium polyphosphate and mixtures thereof;

and mixing molding the molding mixture; and curing the molded molding mixture by heating the molded molding mixture to give a cured casting mold or a cured casting core; and casting nonferrous metals including light metals in the cured casting mold or casting core, wherein the phosphorous-containing compound induces three-dimensional stability of the cured casting mold or the cured casting core during the casting process resulting in a reduced deformation under thermal load as measured by a BCIRA hot distortion test with an increase of at least 10% of the time elapsed until hot distortion starts; and wherein the combined use of amorphous silicon dioxide and the phosphorous-containing compound provides the cured casting mold or cured casting core with a hot strength 10 seconds after removal from a molding tool that is enhanced by at least 20% and a storage strength after 3 hours in a controlled-atmosphere cabinet at 25 degrees C. and 75% relative humidity that is enhanced by at least 20%, relative to a cured casting mold or cured casting core obtained from a molding mixture produced without both the amorphous silicon dioxide and the phosphorous-containing compound.

2. The process as claimed in claim 1 wherein the light metal is aluminum.

3. The process as claimed in claim 1, wherein the phosphorus-containing compound is added in the form of a solid to the moulding mixture.

4. The process as claimed in claim 1, wherein the phosphorus-containing compound is added in a dissolved form to the moulding mixture.

5. The process as claimed in claim 1, wherein the particulate metal oxide has a particle size of less than 300 μm.

6. The process as claimed in claim 1, wherein the amorphous silicon dioxide comprises synthetic amorphous silicon dioxide.

7. The process as claimed in claim 1, wherein the phosphorus-containing compound comprises sodium polyphosphate.

8. The process as claimed in claim 1, wherein the molding mixture is molded and cured in a core shooting machine by heating the molded molding mixture.

9. The process as claimed in claim 1, wherein the proportion of the phosphorus-containing compound added to the molding mixture is in an amount of 0.05 to 0.3% by weight, based on the refractory mold raw material.

10. The process as claimed in claim 1, characterized in that the phosphorus-containing compound has a phosphorus content of from 0.5 to 90% by weight, calculated as $P_2O_5$.

11. The process as claimed in claim 1, characterized in that the amorphous silicon dioxide is precipitated silica and/or pyrogenic silica.

12. The process as claimed in claim 1, characterized in that the water glass has an $SiO_2/M_2O$ ratio in the range from 1.6 to 3.5, where M represents sodium ions and potassium ions.

13. The process as claimed in claim 1, characterized in that the water glass has a solids content of $SiO_2$ and $M_2O$ in the range from 30 to 60% by weight.

14. The process as claimed in claim 1, characterized in that the binder is present in a proportion of less than 20% by weight in the molding mixture.

15. The process as claimed in claim 1, characterized in that the particulate metal oxide is present in a proportion of from 2 to 60% by weight, based on the binder.

16. The process as claimed in claim 1, characterized in that the molding mixture is produced by the process of providing the refractory mold raw material;

admixing the refractory mold raw material with solid constituents which comprise at least the particulate metal oxide and the phosphorus-containing compound, mixing the components to form a dry mix; and adding liquid components to the dry mix, the liquid components comprising at least the water glass.

17. The process as claimed in claim 1, wherein the heating of the molding mixture is cured by the action of microwaves.

18. The process as claimed in claim 1, wherein the proportion of the phosphorous-containing compound added to the molding mixture is in an amount of 0.05 to 0.45% by weight, based on the refractory mold raw material.

19. The process as claimed in claim 1, characterized in that the molding mixture is heated to a temperature in the range from 100 to 300° C. for curing.

20. The process as claimed in claim 1, wherein heated air having a temperature of 100° to 180° C. is blown into the molded molding mixture for curing.

* * * * *